US007746238B2

(12) United States Patent
Behle et al.

(10) Patent No.: US 7,746,238 B2
(45) Date of Patent: Jun. 29, 2010

(54) SMOKE WARNING SYSTEM

(75) Inventors: Kai Behle, Stuhr (DE); Klaus Schmoetzer, Stuhr (DE)

(73) Assignee: Airbus Deutschland GmbH (DE)

( * ) Notice: Subject to any disclaimer, the term of this patent is extended or adjusted under 35 U.S.C. 154(b) by 290 days.

(21) Appl. No.: 11/572,311

(22) PCT Filed: Jul. 19, 2005

(86) PCT No.: PCT/EP2005/007876

§ 371 (c)(1),
(2), (4) Date: Jan. 18, 2007

(87) PCT Pub. No.: WO2006/008145

PCT Pub. Date: Jan. 26, 2006

(65) Prior Publication Data

US 2008/0061996 A1 Mar. 13, 2008

Related U.S. Application Data

(60) Provisional application No. 60/589,272, filed on Jul. 19, 2004.

(30) Foreign Application Priority Data

Jul. 19, 2004 (DE) ..... 10 2004 034 904

(51) Int. Cl.
*G08B 17/10* (2006.01)

(52) U.S. Cl. ..... 340/628; 340/521; 340/522; 340/286.05; 340/945

(58) Field of Classification Search ..... 340/628–632, 340/521, 286.05, 511, 522, 514, 577, 584, 340/963, 945

See application file for complete search history.

(56) References Cited

U.S. PATENT DOCUMENTS

| | | | | |
|---|---|---|---|---|
| 4,464,651 | A * | 8/1984 | Duhame | 340/521 |
| 4,644,331 | A | 2/1987 | Matsushita et al. | 340/587 |
| 5,589,824 | A * | 12/1996 | Lynch | 340/628 |
| 5,699,043 | A * | 12/1997 | Vane et al. | 340/514 |
| 5,818,326 | A * | 10/1998 | Winterble et al. | 340/286.05 |
| 6,107,925 | A | 8/2000 | Wong | 340/628 |
| 7,333,129 | B2 * | 2/2008 | Miller et al. | 348/162 |

FOREIGN PATENT DOCUMENTS

| | | |
|---|---|---|
| DE | 3917205 | 8/1990 |
| DE | 101 09 362 | 9/2002 |
| EP | 0 729 123 | 11/1995 |
| EP | 1 437 701 | 12/2003 |
| JP | 10-222775 | 8/1998 |
| JP | 10-326390 | 12/1998 |
| JP | 2001-101540 | 4/2001 |
| SU | 1455351 A1 | 1/1989 |

OTHER PUBLICATIONS

International Search Report PCT/EP2005/007876 dated Oct. 13, 2005 (European Patent Office NL).

Li Dingguo et al,. "Design of a Low-Price Smoke and Temperature Alarm Detector", Coalmine Design, vol. 10, Dec. 12, 1996, pp. 30-31, with English language translation, 6 pages.

Russian Office Action, dated Jun. 19, 2009, issued in corresponding Russian Patent Application No. 2006146347/09 (050619), total 4 pages; English Translation attached, 6 pages.

* cited by examiner

*Primary Examiner*—Anh V La
(74) *Attorney, Agent, or Firm*—Ostrolenk Faber LLP

(57) ABSTRACT

In a smoke warning system ambient conditions are included in the evaluation of the smoke warning transmitter statuses, or the internal signal evaluation in the smoke warning transmitter is influenced. In this procedure the alarm threshold of the system is raised under certain ambient conditions so that the smoke warning transmitter per se is set so as to be less sensitive.

15 Claims, 1 Drawing Sheet

SMOKE WARNING SYSTEM

CROSS REFERENCE TO RELATED APPLICATION

The present application is a 35 U.S.C. §§ 371 national phase conversion of PCT/EP2005/007876, filed 19 Jul. 2005, which claims the benefit of the filing date of U.S. Provisional Patent Application No. 60/589,272 filed Jul. 19, 2004 and of German Patent Application No 10 2004 034 904.5 filed Jul. 19, 2004, the disclosures of which are herein incorporated by reference. The PCT Application was published in the English Language.

BACKGROUND OF THE INVENTION

The invention relates to a smoke warning system in particular for use in aircraft.

Smoke warning systems in common use function with optical smoke warning transmitters. These smoke warning transmitters apply the so-called diffused-light principle with a specified alarm threshold. In the case where there is no smoke and there are no particles, the receiver does not receive a signal because there is a barrier between the light source and said receiver. However, if smoke particles (or other particles) are encountered in this region, then the light is scattered and the receiver registers a corresponding signal rise. If this signal rise exceeds a specified threshold value, the smoke warning transmitter issues an alarm.

However, the above-mentioned functional principle is associated with a disadvantage in that not only smoke particles but all aerosols cause light scattering and can thus cause the smoke warning transmitter to assume an alarm state. In practical application it has been shown that for example fog, dust or even the use of insecticides has caused false alarms.

In most applications such false alarms pose a safety risk. For this reason, high priority is accorded to minimising the probability of faults occurring.

The above-mentioned problem is even more acute in the case of mobile smoke warning systems which at times are confronted with quickly changing ambient conditions.

SUMMARY OF THE INVENTION

It is thus an object of the invention to provide a smoke warning system which in changing ambient conditions minimises the probability of a false alarm.

The above-mentioned object is met as stated in claim 1. Advantageous improvements of the invention are stated in the dependent claims.

The smoke warning system according to the invention is preferably used in aircraft, wherein, in the assessment as to whether an alarm is to be issued, an ambient condition such as for example temperature, atmospheric humidity, wind, type of the load to be transported, etc. is included in the evaluation of a status signal that is transmitted by a smoke warning transmitter.

According to an exemplary embodiment of the invention, the system according to the invention comprises an evaluation device which from a smoke warning transmitter receives a status that is characteristic of a smoke situation, and, taking into account an ambient condition acquired by an acquisition device, evaluates this status so as to, based on the evaluation result, trigger an alarm via an output device.

This may be associated with the advantage that the smoke warning transmitter itself does not have to be adjustable. The probability of a false alarm occurring may be minimised in that the signal supplied by the smoke warning transmitter is evaluated by a separate device, taking into account the ambient condition.

According to another exemplary embodiment of the system according to the invention, smoke warning transmitters are used whose sensitivity is adjustable. Their sensitivity is set based on the ambient condition received by the acquisition device.

According to an exemplary embodiment of the invention, the ambient conditions, which hereinafter are also referred to as input parameters, are continuously acquired via at least one sensor.

In this way it becomes possible to quickly adjust the smoke warning system to currently valid ambient conditions.

According to one aspect of the invention, the alarm threshold of the system is thus raised under certain ambient conditions so that the smoke warning transmitter per se is set so as to be less sensitive. In this way, the probability of false alarms occurring under "unclean" ambient conditions (for example dust, fog) can be considerably reduced when compared to smoke warning systems with a fixed alarm threshold. This is above all advantageous in systems in mobile applications (for example aircraft, railway, submarine systems) because these systems are at times subjected to quickly changing ambient conditions.

Below, an advantageous exemplary embodiment of the invention is described in detail with reference to FIG. 1.

DESCRIPTION OF A PREFERRED EMBODIMENT

Figure 1:
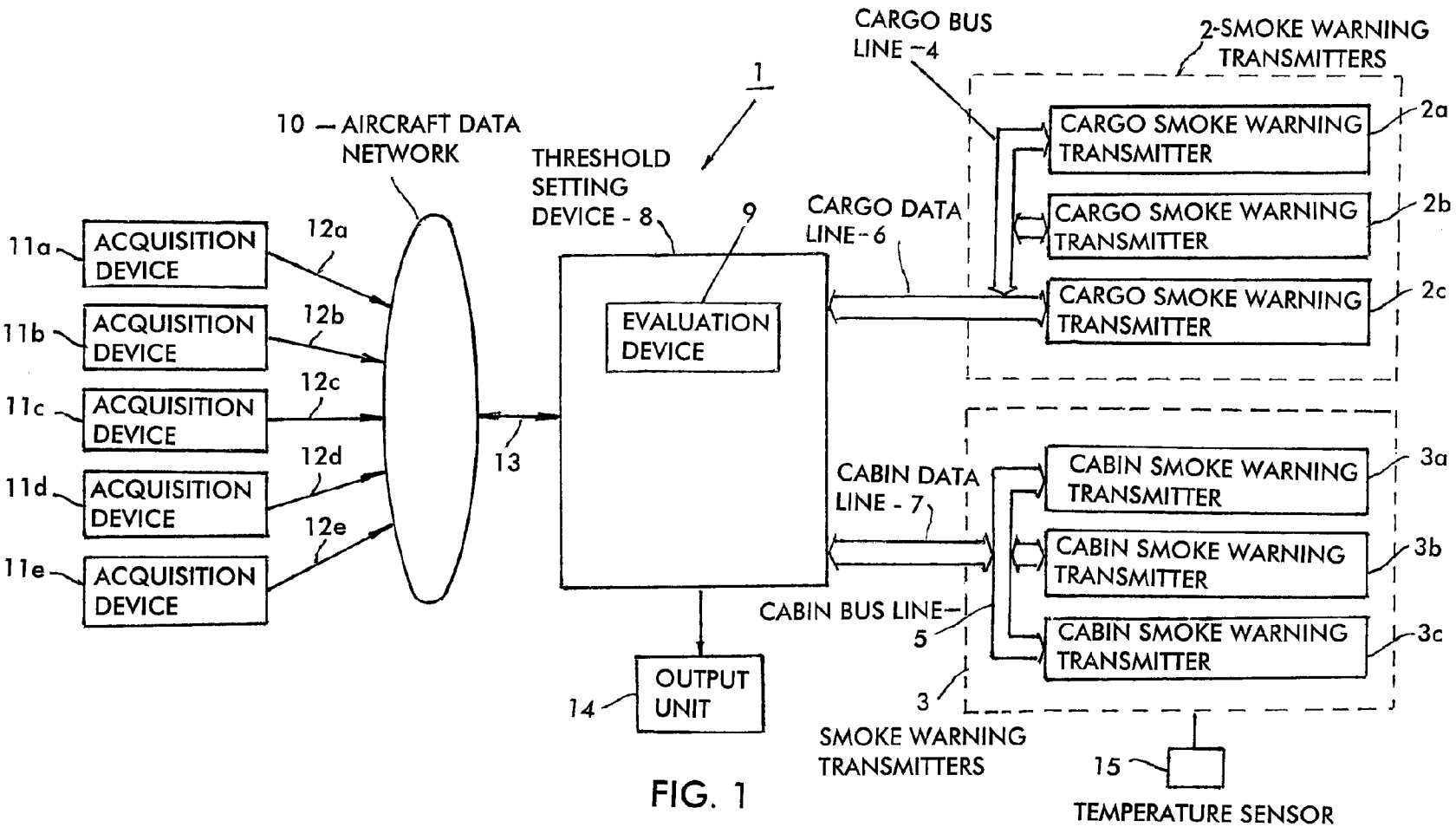
FIG. 1 shows a smoke warning system 1 for application in an aircraft, according to a preferred embodiment of the invention.

As shown in FIG. 1, the system 1 comprises two groups of smoke warning transmitters 2, 3 which are for example arranged at critical positions in an aircraft (not shown).

According to FIG. 1, the group 2 of smoke warning transmitters comprises three smoke warning transmitters 2 *a*-2 *c* which are for example arranged in the cargo compartment of an aircraft. The smoke warning transmitters 2 *a*-2 *c* are electrically interconnected via a bus line 4 and can for example exchange data among themselves via this bus line 4.

According to the exemplary embodiment, the second group 3 of smoke warning transmitters shown in FIG. 1 comprises three smoke warning transmitters 3 *a*-3 *c* which are arranged in the cabin space of the aircraft. The smoke warning transmitters 3 *a*-3 *c* are electrically interconnected via a bus line 5 and can exchange data among themselves via this bus line 5.

Of course, the two groups 2, 3 of smoke warning transmitters can also be interconnected in order to exchange data among themselves.

The smoke warning transmitters 2 *a*-2 *c* and 3 *a*-3 *c* provide status information which is characteristic for an existing smoke situation in the vicinity of the respective smoke warning transmitters.

As shown in FIG. 1, group 2 of the smoke warning transmitters is connected to a device 8 via a data line 6, while group 3 of the smoke warning transmitters in the cabin space is connected to said device 8 via a data line 7.

The device 8 is used for setting an alarm threshold of the smoke warning system 1; said device 8 comprises for example an evaluation device 9. This evaluation device 9 receives information concerning the status of the smoke warning transmitters 2 *a*-2 *c* via the bus line 4 and the data line 6. Similarly, the evaluation device 9 receives information concerning the status of the smoke warning transmitters 3 *a*-3 *c* via the bus line 5 and the data line 7. The information received can for example be stored in a storage device (not shown) inside or outside the device 8. Instead of the data lines and the bus line, it is also possible to provide a single bus line.

Furthermore, the device 8 according to the preferred embodiment is connected to an aircraft data network 10. The connection can either be a wireless connection or a wire connection. The aircraft data network 10 receives data from various acquisition devices 11 *a*-11 *e*, which collect information concerning environmental conditions.

The acquisition device 11 *a* is for example a central maintenance system which, via a connection 12 *a*, transmits flight data to the aircraft data network 10 during a flight.

The acquisition device 11 *b* is for example a flight management system which transmits information concerning the destination to the aircraft data network 10 via a connection 12 *b*.

The acquisition device 11 *c* is for example a door control system which supplies information concerning the status of doors (for example the cargo compartment door) to the aircraft data network 10 via a connection line 12 *c*.

The acquisition device 11 *d* is for example an air data system which supplies information concerning for example the temperature, humidity, pressure etc. of the air to the aircraft data network 10 via a connection 12 *d*.

The acquisition device 11 *e* is for example a flight warning system which supplies corresponding information to the aircraft data network 10 via a connection 12 *e*.

As indicated by dashed lines in FIG. 1, any desired number of acquisition devices can be provided in system 1.

ambient conditions from the acquisition devices 11 *a*-11 *e* via the connection interface 13 and the aircraft data network 10.

Furthermore, as shown in FIG. 1, the device 8 is connected to an output device 14, for example a display, which is arranged in the aircraft's cockpit (not shown).

As described above, the ambient conditions are acquired by the acquisition devices 11 *a*-11 *e* and are continuously provided, and are for example requested by the device 8. Based on these ambient conditions (hereinafter also referred to as input parameters) and the information relating to the status of the smoke warning transmitters 2 *a*-2 *c* and 3 *a*-3 *c*, the evaluation unit 9 calculates a corresponding command for adapting the alarm threshold of the system 1. As an alternative, the evaluation device 9 can also supply a corresponding command to a respective smoke warning transmitter in order to set its sensitivity.

Adaptation of the alarm threshold preferably take place depending on the following parameters:

- destination with respective ambient parameters (temperature, atmospheric humidity, wind force, etc.) and special characteristics;
- status of the cargo compartment door (closed, open); and
- type of load (for example animals, industrial goods, perishable goods).

According to the exemplary embodiment, the procedure to be adhered to is as set out in the following status table. Smoke warning transmitter statuses 1-3 correspond to sensitivity levels:

1. high sensitivity; alarm is issued for example at 3% reduction in light intensity per m;
2. medium sensitivity; alarm is issued for example at 6% reduction in light intensity per m; and
3. low sensitivity; alarm is issued for example at 9% reduction in light intensity per m.

| Condition | 1<br>ΔT > 20° | 2<br>rH > 60% | 3<br>Critical freight loaded | 4<br>Destination critical | 5<br>Cargo door open | 6<br>Cond. 1-5 not met |
|---|---|---|---|---|---|---|
| ΔT > 20° | 2 | 3 | 3 | 3 | 3 | — |
| rH > 60% | 3 | 2 | 3 | 3 | 3 | — |
| Critical freight loaded | 3 | 3 | 2 | 3 | 3 | — |
| Destination critical | 3 | 3 | 3 | 2 | 3 | — |
| Cargo door open | 3 | 3 | 3 | 3 | 2 | — |
| Cond. 1-5 not met | — | — | — | — | — | 1 |

ΔT > 20°: temperature difference > 20° (outside - inside)
rH > 60%: relative atmospheric humidity > 60% (outside)
Critical freight loaded: for example chickens
Destination critical: for example dusty environment According to the invention, the acquisition devices 11 *a*-11 *e*, for example, continuously supply current data to the aircraft data network 10, which transmits this data automatically or on request to the device 8 via a connection interface 13. The connections 12 *a*-12 *e*, via which the respective acquisition devices 11 *a*-11 *e* are connected to the aircraft data network, can be wireless or wired connections.

Likewise, the connection interface 13 between the aircraft data network 10 and the device 8 can be a wireless or wired connection.

According to the exemplary embodiment, as shown in FIG. 1, the evaluation device 9 receives information concerning the Although, above, the invention has been described with reference to an application in an aircraft, the system according to the invention can also advantageously be used in other mobile applications (for example relating to railways, submarines, motor vehicles), because these systems can be subjected to quickly changing ambient conditions.

Although, above, the invention has been described with reference to a preferred embodiment, it is understood that a person with technical skills in this field can make modifications and alterations without leaving the scope of protection.

For example, a smoke warning transmitter can comprise temperature sensors 15 and issue an alarm if a critical temperature value is exceeded, irrespective of the ambient conditions. Similarly, the ambient conditions may be entered by a user, for example via a keypad.

| List of reference characters: | |
|---|---|
| 1 | System |
| 2, 3 | Groups of smoke warning transmitters |
| 2a-2c | Smoke warning transmitters in the cargo compartment |
| 3a-3c | Smoke warning transmitters in the cabin space |
| 4 | Bus line in the cargo compartment |
| 5 | Bus line in the cabin space |
| 6 | Data line to the cargo compartment |
| 7 | Data line to the cabin space |
| 8 | Device |
| 9 | Evaluation device |
| 10 | Aircraft data network |
| 11a-11e | Acquisition devices |
| 12a-12e | Connections |
| 13 | Connection interface |
| 14 | Output unit |
| 15 | Temperature sensor |

The invention claimed is:

1. A system for smoke warning for an aircraft, the system operable to communicate via an aircraft data network and comprising:

a smoke warning transmitter operable to detect a smoke situation;

a plurality of acquisition devices, each acquisition device of the plurality of acquisition devices operable to detect an ambient condition different from remaining acquisition devices of the plurality of acquisition devices, the plurality of acquisition devices including:

a central maintenance system device operable to transmit, as a first ambient condition, flight data to the aircraft data network during flight, a flight management system device operable to transmit, as a second ambient condition, signaling concerning an aircraft destination to the aircraft data network, a door control system device operable to transmit, as a third ambient condition, signaling concerning a status of doors to the aircraft data network, an air data system device operable to transmit, as a fourth ambient condition, signaling concerning air temperature, humidity and pressure to the aircraft data network, and a flight warning system device operable to transmit, as a fifth ambient condition, flight warning signaling to the aircraft data network;

a threshold setting device operable to receive at least one ambient condition of the first, second, third, fourth, and fifth acquired ambient condition via the aircraft data network and to set an alarm threshold of the smoke warning system according to the at least one acquired ambient condition; and an output device for issuing an alarm when the set alarm threshold is reached.

2. The system of claim 1, comprising an evaluation device operable to receive from the smoke warning transmitter a status indication of the smoke situation, and according to the at least one ambient condition acquired to evaluate the smoke situation, to generate an evaluation result, and, when the evaluation result reaches the set alarm threshold, to signal the output device to issue the alarm.

3. The system of claim 1, wherein the smoke warning transmitter in is operable to receive signaling and to modify internal signal evaluation of the smoke warning transmitter to adjust a sensitivity level of the smoke warning transmitter based on the at least one acquired ambient condition.

4. The system of claim 1, wherein at least one acquisition device of the plurality of acquisition devices comprises at least one sensor operable for continuous acquisition of a respective ambient condition, and the at least one acquisition device is operable to continuously signal to the aircraft data network, as a continuous acquired ambient condition, signaling according to the at least one sensor.

5. The system of claim 1, wherein at least one acquisition device of the plurality of acquisition devices comprises a keypad operable to receive human input representing a respective ambient condition.

6. The system of claim 1, wherein the output device comprises a display device operable to display an alarm visually or visually and acoustically.

7. The system of claim 1, wherein the threshold setter device is operable to receive at least two of the first, second, third, fourth and fifth acquired ambient conditions, and to set the alarm condition according to the at least two acquired ambient conditions.

8. The system of claim 1, wherein the threshold setter device is operable to receive at least three of the first, second, third, fourth and fifth acquired ambient conditions, and to set the alarm condition according to the at least three acquired ambient conditions.

9. The system of claim 1, wherein the threshold setter device is operable to receive at least four of the first, second, third, fourth and fifth acquired ambient conditions, and to set the alarm condition according to the at least four acquired ambient conditions.

10. The system of claim 1, wherein the threshold setter device is operable to receive each of the first, second, third, fourth and fifth acquired ambient conditions, and to set the alarm condition according to each of the acquired ambient conditions.

11. An aircraft smoke warning device and connected to a data line connected to a smoke warning transmitter for detecting a smoke situation device for communicating with an alarm output, the aircraft smoke warning device further connected to an aircraft data network connected a central maintenance device for transmitting, as a first ambient condition, flight data to the aircraft data network during flight, a flight management device for transmitting, as a second ambient condition, signaling concerning an aircraft destination to the aircraft data network, a door control device for transmitting, as a third ambient condition, signaling concerning a status of doors to the aircraft data network, an air data device for transmitting, as a fourth ambient condition, signaling concerning air temperature, humidity and pressure to the aircraft data network, and a flight warning device for transmitting, as a fifth ambient condition, flight warning signaling to the aircraft data network, the device comprising:

a threshold setter operable to receive the smoke situation signaling and to receive via the aircraft data network at least one ambient condition of the first, second, third, fourth, and fifth acquired ambient conditions and to set an alarm threshold according to the at least one ambient condition; and an evaluation device operable to evaluate the smoke situation according to the alarm threshold and to signal the alarm output device when the alarm threshold is reached.

12. The aircraft smoke warning device of claim 11, wherein the threshold setter device is operable to receive at least two of the first, second, third, fourth and fifth acquired ambient conditions, and to set the alarm condition according to the at least two acquired ambient conditions.

13. The aircraft smoke warning device of claim 12, wherein the threshold setter device is operable to receive at least three of the first, second, third, fourth and fifth acquired ambient conditions, and to set the alarm condition according to the at least three acquired ambient conditions.

14. The aircraft smoke warning device of claim 13, wherein the threshold setter device is operable to receive at least four of the first, second, third, fourth and fifth acquired ambient conditions, and to set the alarm condition according to the at least four acquired ambient conditions.

15. The aircraft smoke warning device of claim 14, wherein the threshold setter device is operable to receive each of the first, second, third, fourth and fifth acquired ambient conditions, and to set the alarm condition according to each of the acquired ambient conditions.

* * * * *